United States Patent [19]

Burrell

[11] 4,159,604

[45] Jul. 3, 1979

[54] JOIST

[75] Inventor: Michael P. Burrell, Mississauga, Canada

[73] Assignee: Anthes Equipment Limited, Ontario, Canada

[21] Appl. No.: 867,458

[22] Filed: Jan. 5, 1978

[51] Int. Cl.[2] ..... E04C 3/292; E04C 3/04

[52] U.S. Cl. ..... 52/376; 52/729

[58] Field of Search ..... 52/39, 376, 710, 729, 52/368

[56] References Cited

U.S. PATENT DOCUMENTS

| | | | |
|---|---|---|---|
| 1,453,996 | 5/1923 | Riddle | 52/376 |
| 2,387,432 | 10/1945 | Du Laney | 53/376 |
| 3,787,020 | 1/1974 | Avery | 52/376 |

FOREIGN PATENT DOCUMENTS

| | | | |
|---|---|---|---|
| 941123 | 2/1974 | Canada | 52/376 |
| 95626 | 1/1897 | Fed. Rep. of Germany | 52/368 |
| 582340 | 11/1946 | United Kingdom | 52/376 |
| 637844 | 5/1950 | United Kingdom | 52/376 |
| 650239 | 2/1951 | United Kingdom | 52/710 |

*Primary Examiner*—Alfred C. Perham
*Attorney, Agent, or Firm*—Anthony J. Casella

[57] ABSTRACT

The disclosure relates to the type of joist having an upper chord in the form of an inverted top-hat channel into which an insert is forced. The inner faces of the side walls of the channel converge towards one another at the top of the channel and the width of the bottom of the channel is greater than the width of the bottom of the insert.

6 Claims, 5 Drawing Figures

JOIST

This invention relates to a joist for use in a concrete forming structure for shoring concrete slabs employed in the building industry and, in particular, for use in construction of poured concrete floors. One such joist forms the subject of our Canadian Pat. No. 941,123 which issued on Feb. 5, 1974 and which will be hereinafter termed "the patented joist."

Basically, the patented joist includes a cold rolled substantially U-shaped channel or top chord which has elastically deformable side walls capable of being sprung outwardly to admit a wooden nailable insert into the channel; a lower chord spaced from the top chord by primary and secondary chord connecting means; and a pair of slotted nailer-plates each located at an opposite end of the joist.

A further type of known joist is formed from a pair of cold-rolled channel members welded together in back-to-back relation. The joist has an upper chord of U-shaped cross-section to receive a nailable wooden insert, a lower chord, intermediate chord connecting means having a constant depth, and returning side flanges inhibiting damage to the edges of said joist.

These joists, although admirable for their respective purposes have proved to be heavy and somewhat costly to manufacture.

A still further known type of joist is manufactured from extruded aluminum. This type of joist also has a U-shaped channel or upper chord into which a wooden joist member or insert is forced with the inner surfaces of said channel being provided with serrations to inhibit movement of the insert upwardly in a vertical plane, and, hence, to separate from the channel member.

All of these joists are for the purpose of supporting plywood panels (which are nailed to the wooden inserts) during the pouring of concrete thereon. The inserts must be capable of removal from the channels because over long use, the inserts may become splintered due to the nailing of the plywood panels to the inserts.

The object of the present invention is, therefore, to provide a lightweight joist which is cheaper to manufacture and handle and from which a damaged insert can be quickly removed and replaced.

The invention is illustrated, by way of example, on the accompanying drawings in which.

Figure 1:
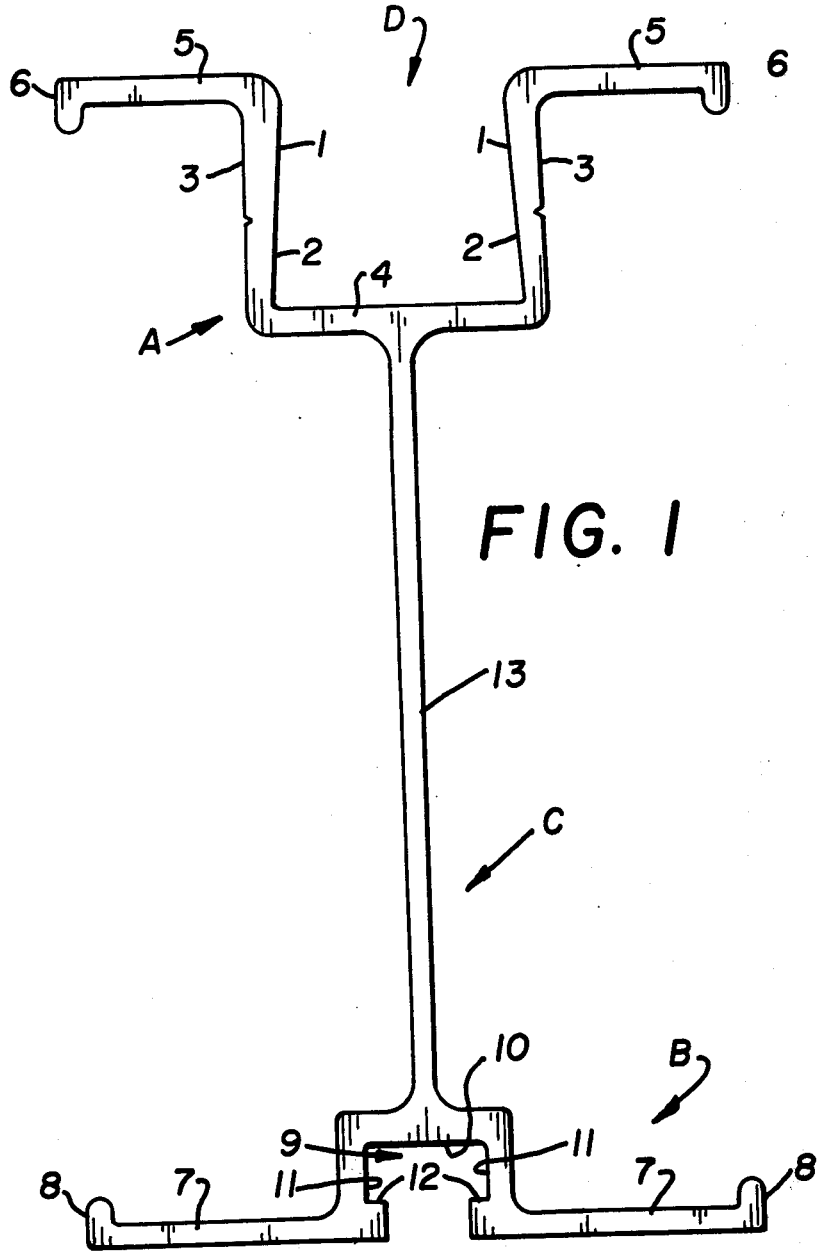
FIG. 1 is an end view of the joist.

Referring to the drawings, the joist shown therein is formed from extruded aluminum and consists of an elongated channel member presenting an upper chord, indicated generally at A, a lower chord indicated generally at B and chord connecting means (indicated generally at C) intermediate said chords A and B.

The upper chord defines a channel (indicated generally at D) which is substantially U-shaped in cross-section and which is formed by side walls 1, having inner 2 and outer faces 3, and a bottom wall 4.

As will be seen from FIG. 1 the inner faces 2 of the side walls 1 converge towards one another in the direction of the upper portion of the channel D and the thickness of each said side wall 1 increases in transverse section from the bottom to the top thereof, with the outer faces 3 being substantially normal to said bottom wall 4.

Each of the side walls 1, at the top thereof, merges into an upper, outwardly extending flange 5 each of which, in themselves, terminates in a downwardly extending stub-flange 6 parallel with and spaced from its associated said side wall 1.

The lower chord B is defined by a pair of lower horizontal flanges 7 each parallel with and spaced from the upper flanges 5 and having an overall transverse dimension substantially equal to the overall transverse dimension of the upper chord. Each of the lower horizontal flanges 7 terminates in an upwardly extending stub-flange 8. The interior of the lower chord B also includes a generally T-shaped slot indicated generally at 9 which is adapted to receive a bolt-head 20, the roof 10 of the side walls 11 terminating at its flanges 7 and being connected to a pair of spaced vertical side walls 11, each of said side walls 11 terminating, at its lower end, in a ledge 12 on which the head of the bolt is capable of sitting.

The chord connecting means C comprises a central web 13 extending between the upper A and lower B chords with the stub-flanges 8 being substantially parallel with the vertical axis of said web C.

Employing the basic form of joist, an insert 14 (FIG. 2) which can be of wood, is forced into the channel D the sides of the latter being, to a certain extent elastically deformable, although permitting entry of said insert squeezing the sides thereof towards the top.

At this stage, it would be as well to mention the disadvantage which has always existed with known prior art joists employing an upper U-shaped chord or what is known in the trade as an "inverted top hat." In previously known joists, both the inner and outer faces of the side walls of the channel have always (a) extended parallel to one another and (b) extended parallel with the central vertical axis of the joist. As is also known, the inserts normally employed are of low-grade lumber and it is thus relatively impossible to cut them with exact right-angled corners. Hence, often as not, the inserts have had rounded corners so that when they have been driven into a channel member with bottom right-angled corners, said inserts have only sat on their corners because said right-angled corners would not accommodate the insert. In the majority of cases, therefore, the inserts have sat "proud" of the channel or, in other words, the upper horizontal surface of the insert has been higher than the neighboring and upper horizontal flanges of the joist. Thus when plywood panels have been placed on the joists (to enable the pouring of concrete floors on said panels), only the latter have supported the panels and concrete instead of the inserts and the upper horizontal flanges. The load transfer has therefore been uneven, notwithstanding that the weight has eventually crushed the corners of the insert until it has "sat" on the bottom of the channel.

Thus, by arranging for the diverging walls at the bottom of the channel, this disadvantage has been obviated so that the channel will accommodate rounded corners on the insert without forcing the latter upwardly therein and thereby ensuring that the upper horizontal surface of the insert and the upper horizontal flanges, together, provide an even load bearing surface and a more even load transfer throughout the entire joist. This condition is clearly shown in FIG. 2 where the rounded bottom corners of the insert 14 do not touch the bottom of the channel and whereby the insert 14 sits quite naturally within the channel D with the side walls 1 squeezing or gripping the upper surface of which together with the upper horizontal flanges 5, form an even load-bearing surface for plywood panels 15 upon which the concrete is poured.

Figure 3:
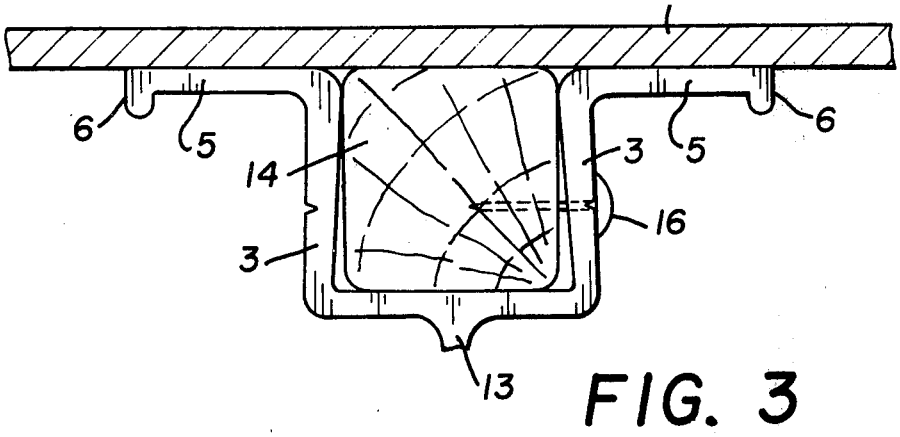
FIGS. 3–5 are detail views.
Figure 4:
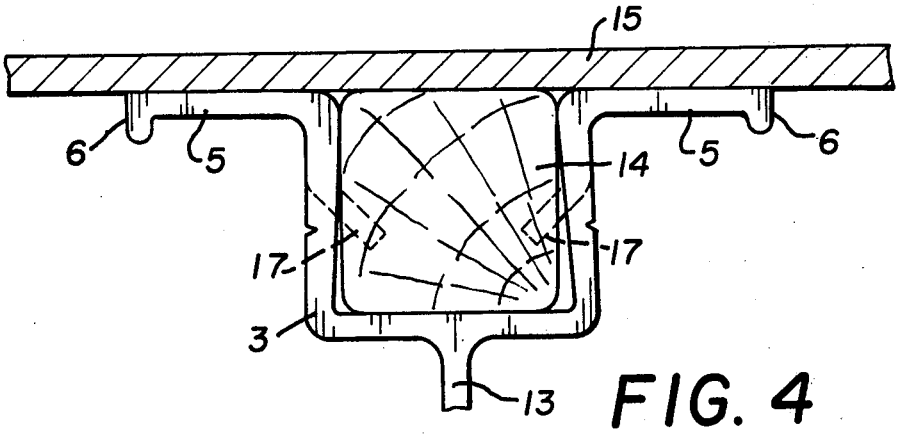

If desired, of course, the inserts can be detachably secured within the channels, as is shown in FIG. 3, by means of nails 16 which are driven through the side walls 1 and into the insert. Alternatively portions of the side walls 1 can be punched inwardly when the insert is in situ within the channel, to form tangs 17 (see FIG. 4), either rectangular, square, or triangular and which bite into the side surfaces of said insert.

Figure 2:
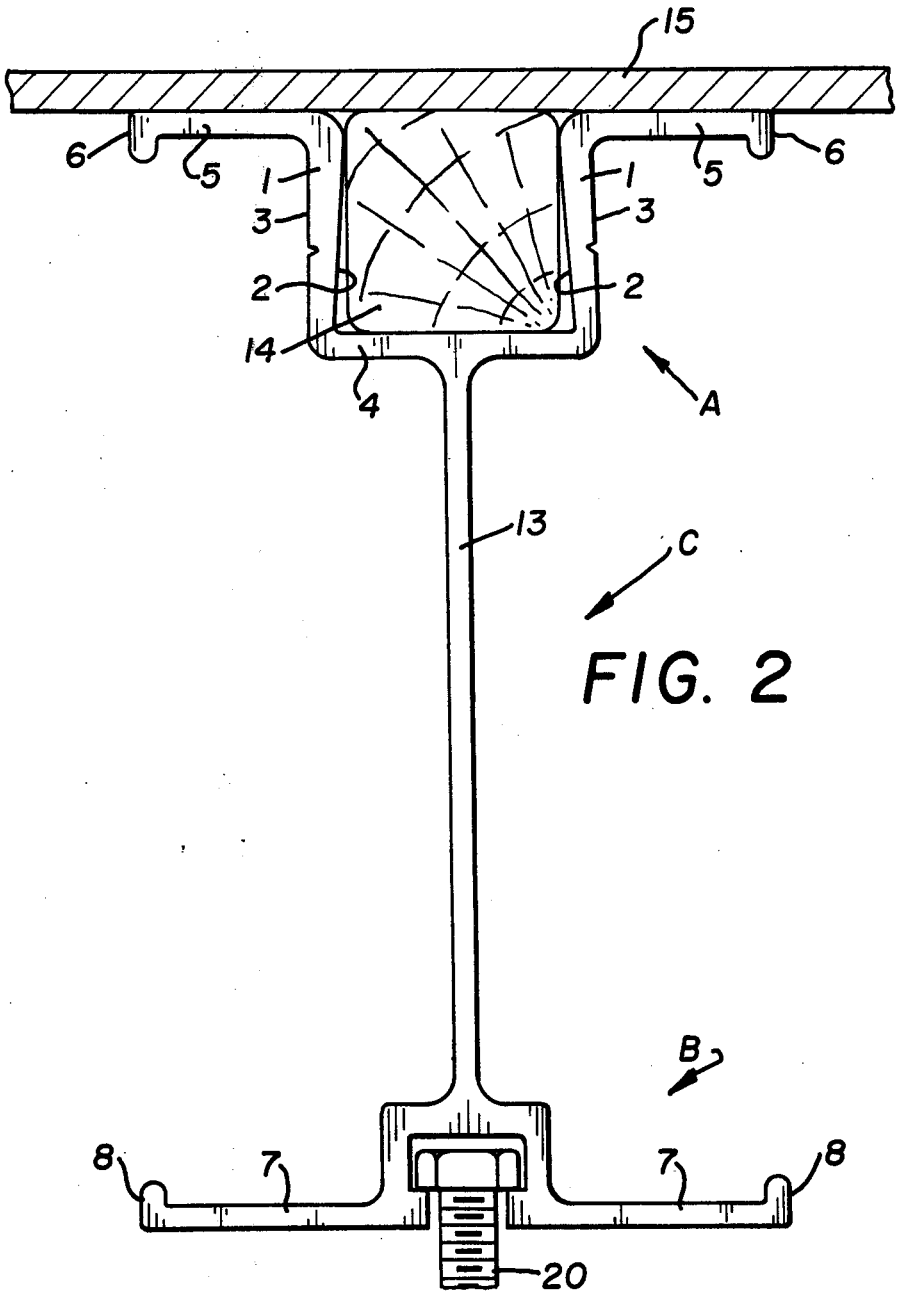
FIG. 2 is a similar view but showing the wooden insert in situ.
Figure 5:
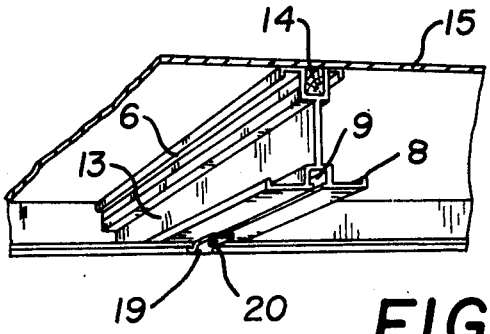

The purpose of the T-shaped slot 9 will be apparent from reference to FIG. 5 where it will be seen that the joist is capable of being clamped to another member 18 (such as an I-beam) by means of a slidable clamp 19 bolted to the joist by means of a bolt 20 the head of which is slidably accommodated in said T-shaped slot, both said clamp and bolt being more clearly shown in FIG. 2.

The reason that the outer face 3 of each side wall 1 is normal to the bottom wall 4 of the channel as opposed to being parallel with each inner face 2 which is angulated with respect to the bottom (thus increasing the thickness of each side wall 1 in transverse section from the bottom to the top thereof), is that it is desired to transmit the load transfer vertically downwardly to the bottom of the channel in the most efficient manner.

The returning stub flanges 6 and 8 have the advantage that damage to the side edges of the horizontal flanges 5 and 7 is inhibited during frequent re-use of the joist.

Although the use of nails 16 has been described above and illustrated in FIG. 3, it will be obvious to those skilled in the art that screws, self-tapping screws or power-actuated studs can be employed to secure the insert within the channel.

I claim:

1. A joist for shoring concrete slabs, said joist consisting of an extruded, elongated channel member presenting an upper chord, a lower chord, and chord connecting means intermediate said chords;

said upper chord defining a channel, substantially U-shaped in cross-section, having side walls with inner and outer faces, and a bottom wall with a flat inner face and an outer face, the inner faces of said side walls being angulated with respect to said planar bottom wall, and converging towards one another in the direction of the upper portion of the channel, the outer faces of said side walls being parallel to one another such that each of said side walls increases in transverse cross-section from the bottom wall to the free end thereof, said side walls being elastically deformable so that they can be sprung outwardly to permit the introduction of a removable insert into said channel, the transverse dimension of the inner face of the bottom wall being greater than the transverse dimension of the removable insert; each of said side walls terminating, at its upper free end in an upper outwardly extending horizontal flange which, in itself, terminates, in a downwardly extending stub-flange parallel with and spaced from its associated said side wall;

said lower chord being defined by a pair of lower horizontal flanges each parallel with and spaced from said upper flanges and terminating in an upwardly extending stub-flange;

said chord connecting means comprising a central web extending between said upper and lower chords, the stub-flanges on said lower chord being substantially parallel with said web member.

2. A joist according to claim 1 including means extending from the side walls of the channel into the sides of the insert to retain the latter in situ.

3. A joist according to claim 2 wherein said means are nails.

4. A joist according to claim 2 wherein said means are tangs projecting from said side walls and integral therewith.

5. A joist according to claim 2 wherein said means are screws.

6. A joist according to claim 2 wherein said means are studs.

* * * * *